United States Patent [19]

Nichols et al.

[11] 4,071,300

[45] Jan. 31, 1978

[54] SELF-PASTING TOOTHBRUSH

[76] Inventors: Roy A. Nichols, 6821 Racliffe St., Bristol, Pa. 19007; Francis L. Anderson, 13110 Theiss Lane, Tomball, Tex. 77375

[21] Appl. No.: 728,435

[22] Filed: Sept. 30, 1976

[51] Int. Cl.[2] ..... B43K 5/06

[52] U.S. Cl. ..... 401/175

[58] Field of Search ..... 401/175, 171–174

[56] References Cited

U.S. PATENT DOCUMENTS

| | | | |
|---|---|---|---|
| 967,686 | 8/1910 | Stubbs | 401/175 |
| 1,309,900 | 7/1919 | MacCorkell | 401/175 |
| 2,638,614 | 5/1953 | Anderson | 401/175 X |
| 3,039,476 | 6/1962 | Reitknecht | 401/175 |
| 3,121,905 | 2/1964 | Shapiro | 401/175 X |

*Primary Examiner*—Stephen C. Pellegrino
*Attorney, Agent, or Firm*—Miller & Prestia

[57] ABSTRACT

Self-pasting toothbrush includes a brush head and a hollow paste reservoir cartridge filled with toothpaste. When the reservoir is rotated in relation to the brush head, a piston is actuated to force toothpaste from the reservoir to within the brush bristle portion.

12 Claims, 2 Drawing Figures

SELF-PASTING TOOTHBRUSH

BACKGROUND OF THE INVENTION

1. Field of the Invention

This application relates to a self-pasting toothbrush with a replaceable toothpaste reservoir that, through rotation of the reservoir, actuates a piston means to deliver toothpaste to within the brush bristle portion. After the paste supply in the reservoir has been exhausted, the user simply removes the paste reservoir and attaches a new one.

2. Discussion of the Prior Art

Various attempts have been made to provide satisfactory self-pasting toothbrushes. One such attempt, U.S. Pat. No. 1,062,480 (LaRocque), discloses the use of such a toothbrush wherein a holder member, hingedly connected to the brush, contains a toothpaste container so that the toothpaste container may be swung into contact with the brush bristles to deliver toothpaste thereupon.

U.S. Pat. No. 2,172,624 (Robert) discloses a mounting for toothbrush bristles that allows the bristles to oscillate as the brush is reciprocated in use. Also, and of primary relevance to the present invention, the '624 patent shows the use of a self-pasting toothbrush in which a rotatable feed screw forces a nut toward the brush end to deposit toothpaste from a hollow paste reservoir to a position below the brush bristles.

These aforementioned toothbrushes, however, suffer from the fact that upon exhaustion of the toothpaste, the user must often spend a few minutes or more to install a new toothpaste supply. Thus, users are easily discouraged from utilizing the brushes.

Moreover, neither brush automatically deposits the stored toothpaste to the centralmost portion of the brush bristles. Such a placement of the toothpaste facilitates both an easy and proper brushing of the teeth.

OBJECTS OF THE INVENTION

Thus, it is an object of the present invention to overcome the aforementioned and other problems of the prior art self-pasting toothbrushes.

Specifically, it is an object of the present invention to provide an improved self-pasting toothbrush having a toothpaste reservoir which is conveniently replaceable.

SUMMARY OF THE INVENTION

These and other objects are met by the self-pasting toothbrush subject of the present invention.

Briefly, this self-pasting toothbrush includes a hollow paste reservoir and a brush head body that are both attached to a connector member so that the reservoir is rotatable in relation to the brush head. A piston, actuated upon rotation of the reservoir, forces toothpaste, contained within the reservoir, through conduit channels formed in the brush head and connector member to deliver a toothpaste supply to within the brush bristle portion.

One end of a threaded feed rod is securely anchored in the connector member while the other end of the feed rod extends into the paste reservoir. A piston, containing a threaded central bore, is threaded onto the feed rod. The outermost portions of the piston are snugly fit within the interior wall of the paste reservoir. Thus, rotation of the reservoir causes the piston to rotate and thus move along the feed rod to force the toothpaste through the conduit channels formed in both the connector member and the brush head.

In one form of the invention, the replaceable reservoir cartridge is snap-fitted to one end of the connector member, while the other end of the connector member is threadedly attached to the brush head by the use of right hand threads. The feed rod is also provided with right hand threads so that when the brush head is held stationary and the reservoir cartridge rotated in a clockwise direction, the piston moves toward the brush head to force the toothpaste through the conduit channels.

In another form of the invention, also with a snap fit of the cartridge to the connector and a right hand threaded mount of connector member to the brush head, the feed rod contains an internal bore throughout the entire longitudinal axis of the rod and the rod is provided with left hand threads about its outermost portions. Consequently, when the brush head is held stationary and the reservoir rotated in a clockwise direction, the piston moves away from the brush head forcing toothpaste toward a closed end portion of the reservoir and then through the feed rod internal bore to subsequently communicate with the conduit channels formed in the connector member and the brush head.

BRIEF DESCRIPTION OF THE DRAWINGS

The invention is further illustrated by the drawings in which the same numerals refer to corresponding parts and in which.

DETAILED DESCRIPTION OF THE INVENTION

Figure 1:
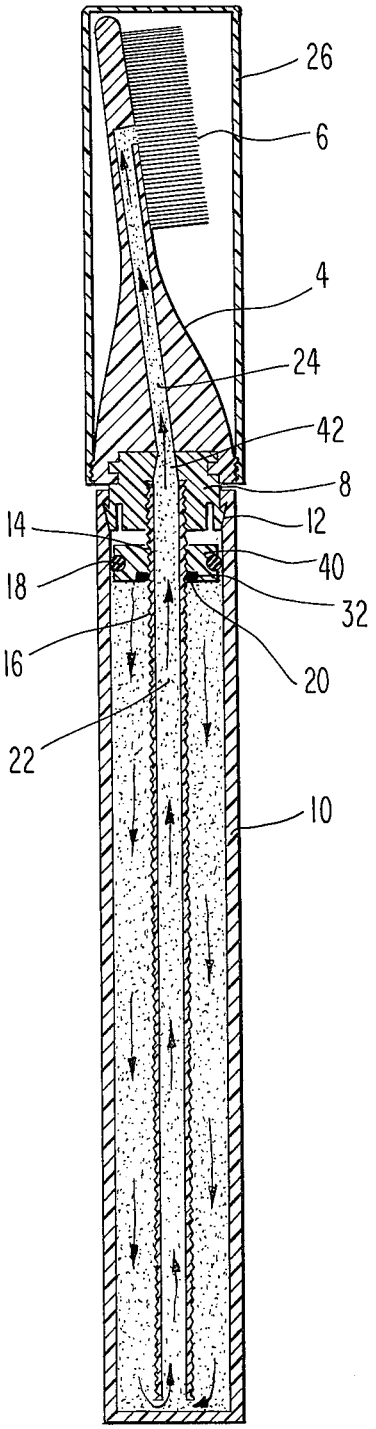
FIG. 1 is a side view, partially cut away to illustrate the invention, of one embodiment of the toothbrush.

With reference to the drawings, and particularly to FIG. 1, there is shown a self-pasting toothbrush 2. Toothbrush 2 includes brush head 4. Brush bristles 6 extend from the face portion of brush head 4, while the bottom portion of brush head 4 is fixedly secured, by threads or the like, over one end portion of connector member 8. The other end portion of connector member 8 is snap-fitted within the open end portion of hollow paste reservoir 10 so that paste reservoir 10 may be rotated about connector member 8. Annular flange 12 is provided around the outermost portions of connector member 8 to facilitate an easy snap-fitting of the connector to the reservoir and to provide proper positioning of paste reservoir 10 so as to allow rotational movement of paste reservoir 10 in relation to brush head 4.

Piston 32 snugly fits inside the inner walls of paste reservoir 10 so that rotation of the reservoir will also cause piston 32 to rotate. Piston 32 contains a centrally located threaded aperture 14 through which extends threaded feed rod 16. One end portion of feed rod 16 is securely anchored by connector member 8, while the other end extends into paste reservoir 10.

In the embodiment illustrated in FIG. 1, feed rod 16 contains left hand threading about its circumference and has an internal bore 22 throughout its longitudinal axis. Connector 8 is attached to brush head 4 by the use of right hand threads. Piston 32 may also contain slidable O-ring seals 18 located in recess 40 that is formed in the outer circumference of the piston. These seals properly prevent toothpaste escape between the piston and internal walls of paste reservoir 10. Thread seal 20 is provided about the central aperture formed in piston 32 so that toothpaste cannot escape along threaded feed rod 16.

In operation, the user simply holds brush head 4 stationary while rotating paste reservoir 10 in a clockwise direction. Piston 32 rotates and moves towards the closed end of paste reservoir 10. Accordingly, toothpaste is forced toward the closed end portion of paste reservoir 10, through internal bore 22 formed in feed rod 16, then through channel 42 formed in the connector member. Conduit 24 then directs the toothpaste to the face portion of bristles 6.

Travel cap 26, removeable mounted over brush head 4 by knurls or the like, provides cover protection for the bristles during travel.

When the toothpaste supply is exhausted, the user simply removes reservoir 10 and the connector 8 to which it is attached from brush head 4 and replaces the reservoir with a new reservoir 10, which includes a new toothpaste supply and new connector 8.

Figure 2:
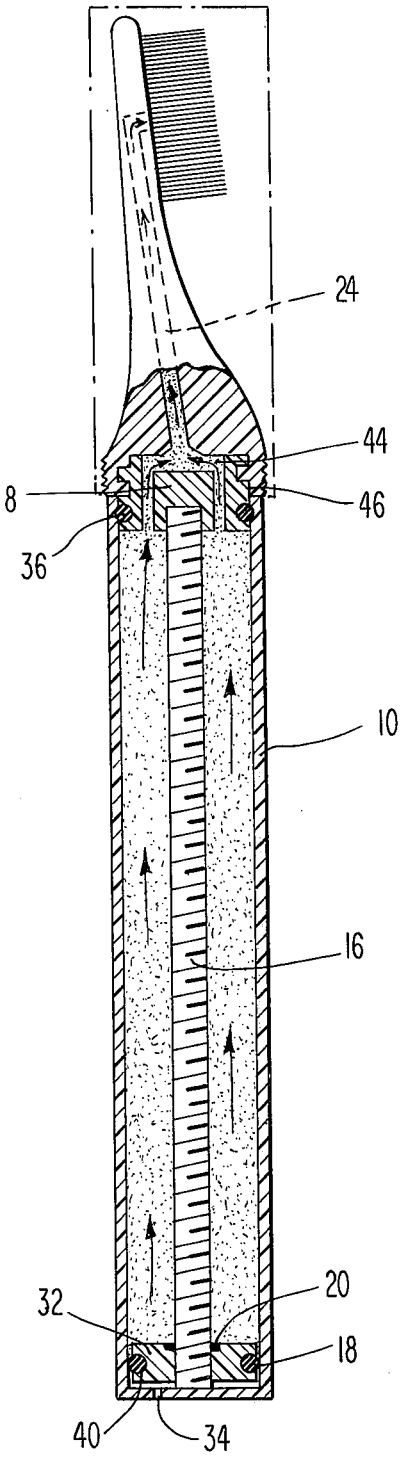
FIG. 2 is a side view, partially cut away, of the preferred embodiment of the present invention.

In the preferred embodiment illustrated in FIG. 2, self-pasting toothbrush 3 includes feed rod 16 containing right hand threads about its circumference. Here again, reservoir 10 is snap-fitted to one end of connector 8, while the other end of connector 8 is threaded to brush head 4 by the use of right hand threads. O-ring seal 36, located between annular recess 46 formed in the connector and annular recess 48 formed in the interior wall of the reservoir, prevents toothpaste leakage from around the circumference of the connector. As in the FIG. 1 embodiment, piston 32 may also contain slidable O-ring seals 18 positioned in recess 40 to prevent toothpaste escape between the piston and internal walls of paste reservoir 10. Channel passages 44 communicate with conduit 24 formed in the brush head. An air vent 34 is punctured through the end wall of paste reservoir 10 to prevent air lock. (Such a vent may also be required in the upper end of reservoir 10 in the embodiment illustrated in FIG. 1.)

To operate the embodiment illustrated in FIG. 2, the user holds the brush head stationary and imparts a clockwise rotational movement to paste reservoir 10. Accordingly, piston 32 is moved towards connector 8 along feed rod 16. Toothpaste is forced through channel 44 and conduit 24 to be deposited at the face portion of the bristles.

Upon exhaustion of the toothpaste supply, the user simply removes paste reservoir 10 including its associated piston, rod and connector, and replaces it with a new paste reservoir having a full supply of toothpaste.

It is apparent to those skilled in the art that many and varied forms of connector members may be utilized to hold the brush head stationary while allowing the paste reservoir to rotate about such connector member. Also, many different sealing members may be used to prevent toothpaste escape between the piston-feed rod interface, piston-reservoir interface, and the reservoir-connector interface. The specification and appended claims are intended to include all such equivalent connector and sealing members within their scope.

It is also apparent that other modifications and variations of this invention as hereinbefore set forth, may be made without departing from the spirit and scope thereof. The specific embodiments described are given by way of example only, and the invention is limited only by the terms of the appended claims.

The following is claimed:

1. A self-pasting toothbrush comprising in combination:

a. a brush head having a face portion and a bottom end;

b. brush bristles extending from said face portion of said brush head;

c. a replaceable cartridge comprising connector means, one end of said connector means removably secured to said bottom end of said brush head, said connector means also having a channel bored therein, a hollow paste reservoir having an open end and a closed end, said open end of said paste reservoir engaged to the other end portion of said connector means, said paste reservoir being rotatable in relation to said brush head, piston means having a threaded bore therethrough, said piston means being snugly positioned within said paste reservoir, and a threaded feed rod, one end of which is fixedly anchored in said connector means, the other end of which is threaded through the bore contained within said piston means, said feed rod extending into said paste reservoir, said various means and members being adapted to permit said piston to move along the axis of said feed rod when said paste reservoir is rotated relative to said brush head, to force any toothpaste located in said reservoir to and through said channel formed in said connector means;

d. conduit means bored through said brush head to communicate with said channel bored in said connector means, said conduit means adapted to deliver toothpaste to the face portion of said brush and thus to said bristles.

2. A self-pasting toothbrush as recited in claim 1, wherein said piston means moves towards said connector member upon rotation of said paste reservoir.

3. A self-pasting toothbrush as recited in claim 2, further including a sealing means positioned in an annular recess formed around the circumference of said piston means and a thread sealing means positioned about said bore in said piston means, said first sealing means being slidably engaged between said piston means and said hollow paste reservoir, and being adapted to prevent toothpaste exit therebetween, said thread sealing means adapted to prevent toothpaste exit along said feed rod.

4. A self-pasting toothbrush as recited in claim 2, further including an air vent located in said closed end portion of said hollow paste reservoir.

5. A self-pasting toothbrush as recited in claim 1, wherein said threaded feed rod has an internal bore running throughout the axis of said rod.

6. A self-pasting toothbrush as recited in claim 3, wherein both of said sealing menas are O-rings.

7. A self-pasting toothbrush as recited in claim 5, wherein said piston means moves away from said connector means upon rotation of said paste reservoir to force toothpaste towards said closed end of said paste reservoir and through said internal bore inside of said threaded feed rod.

8. A self-pasting toothbrush as recited in claim 7, further including:

a. a first sealing means, said first sealing means being located between two annular recesses, said first recess formed around the circumference of the end portion of said connector means that is engaged to said open end of said paste reservoir, said second recess formed about the interior of said hollow paste reservoir that is engaged to said connector means, said first sealing means adapted to prevent toothpaste escape from between said connector means and said reservoir;

b. a second sealing means, said second sealing means positioned within an annular recess formed around the circumference of said piston means, said sealing means being slidably engaged between said piston means and said hollow paste reservoir and adapted to prevent toothpaste exist therebetween;

c. a third sealing means, said third sealing means positioned about said bore in said piston means, said third sealing means adapted to prevent toothpaste exit along said feed rod.

9. A self-pasting toothbrush as recited in claim 8, wherein said three sealing means are O-rings.

10. A self-pasting toothbrush as recited in claim 1, further including a traveling cover removably mounted over said brush head.

11. A self-pasting toothbrush as recited in claim 1, wherein said connector means further includes an annular flange surrounding said connector means, said flange adapted to position said paste reservoir with respect to said brush head.

12. A replaceable toothpaste reservoir cartridge adapted for detachable engagement with the brush head of a self-pasting toothbrush, said cartridge comprising:

a. a hollow toothpaste reservoir having an open end and a closed end;

b. connector means, one end of which is adapted for demountable attachment to said brush head, the other end engaged to the open end portion of said toothpaste reservoir, said connector means including means for allowing rotational movement of said reservoir in relation to said brush head;

piston means having a threaded bore therethrough, said piston means being snugly positioned within said paste reservoir, and d. a threaded feed rod, one end of which is fixedly anchored in said connector means, the other end of which is threaded through the bore contained within said piston means, said feed rod extending into said paste reservoir, said various means and members being adapted to permit said piston to move along the axis of said feed rod when said paste reservoir is rotated relative to said brush head to deliver toothpaste to said brush head.

* * * * *